United States Patent [19]

De Haven et al.

[11] 4,346,644

[45] Aug. 31, 1982

[54] FOLDOUT CRADLE APPARATUS FOR MOUNTING AN AUTOMATIC CANNON TO A TURRET EXTERIOR

[75] Inventors: Vernet F. De Haven; Forrest Airhart, both of Huron, Ohio

[73] Assignee: Ares, Inc., Port Clinton, Ohio

[21] Appl. No.: 122,661

[22] Filed: Feb. 19, 1980

[51] Int. Cl.[3] ..... F41F 21/14

[52] U.S. Cl. ..... 89/37 B

[58] Field of Search ..... 89/36 H, 36 K, 37 R, 89/37 A, 37 B, 40 B

[56] References Cited

U.S. PATENT DOCUMENTS 3,379,098 4/1968 Zurbuchen ..... 89/40 B 3,687,003 8/1972 Zurbuchen et al. ..... 89/36 K

*Primary Examiner*—Stephen C. Bentley

*Attorney, Agent, or Firm*—Allan R. Fowler

[57] ABSTRACT

Cradle apparatus for mounting an automatic cannon to an elevationally rotatable plate positioned at an exterior region of a weapons system turret or cupola includes an elongate, rigid, box-like cradle and first, second and third universal ball connections, arranged in a generally triangular configuration, for mounting the cradle to the rotatable plate. Each of the connections includes cradle portions fixed to the cradle and plate portions fixed to the plate. The first, uppermost connection includes means for releasably latching together the cradle and plate portions thereof; whereas, the second and third, lower connections define a cradle hinge line about which the cradle is pivotable between open and closed conditions relative to the plate when the first connection cradle and plate portions are unlatched. Means are provided in the cradle for mounting an automatic cannon in a manner enabling ready access to receiver portions thereof when the cradle is in the open condition. The three cradle connections are configured to enable both azimuth and elevational bore sight adjustment of a cannon mounted in the cradle by adjusting the position of the closed cradle relative to the plate. Mechanical assist means are provided for controlling pivotal movement of the cradle between the open and closed positions.

23 Claims, 18 Drawing Figures

FIG. 3.
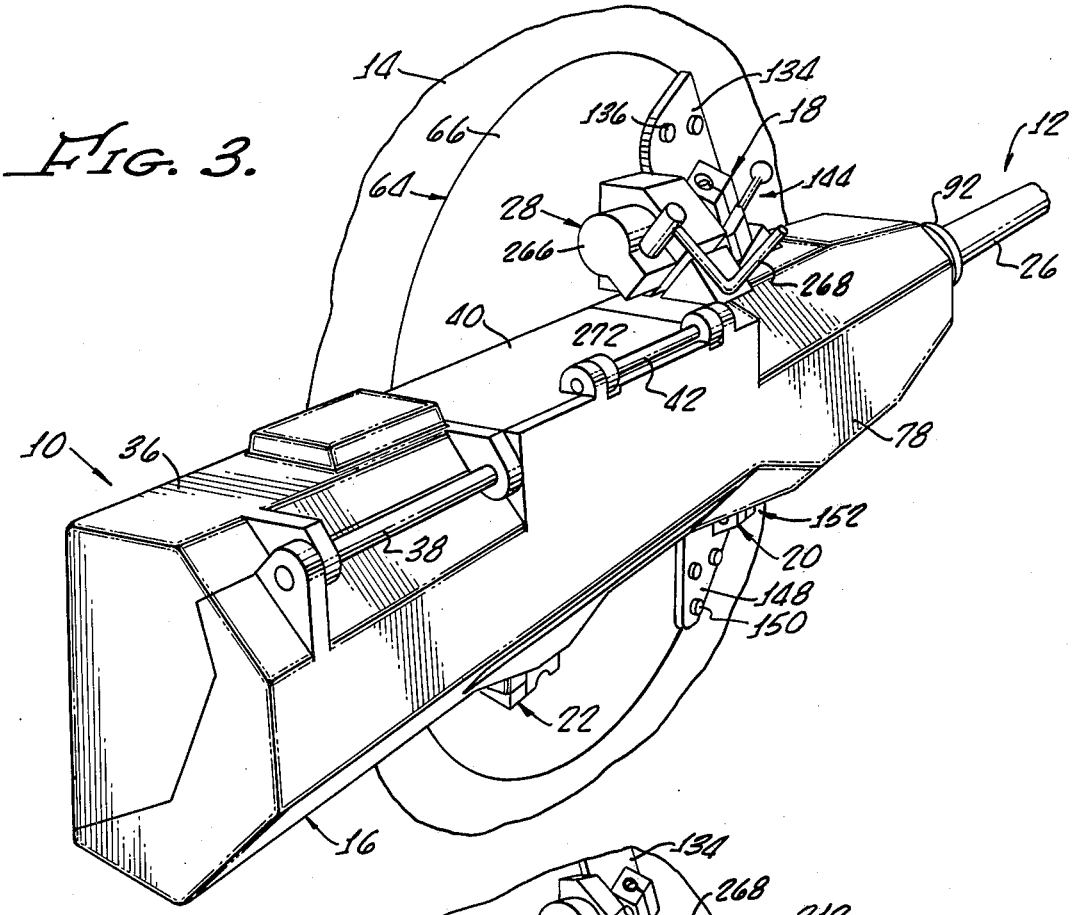
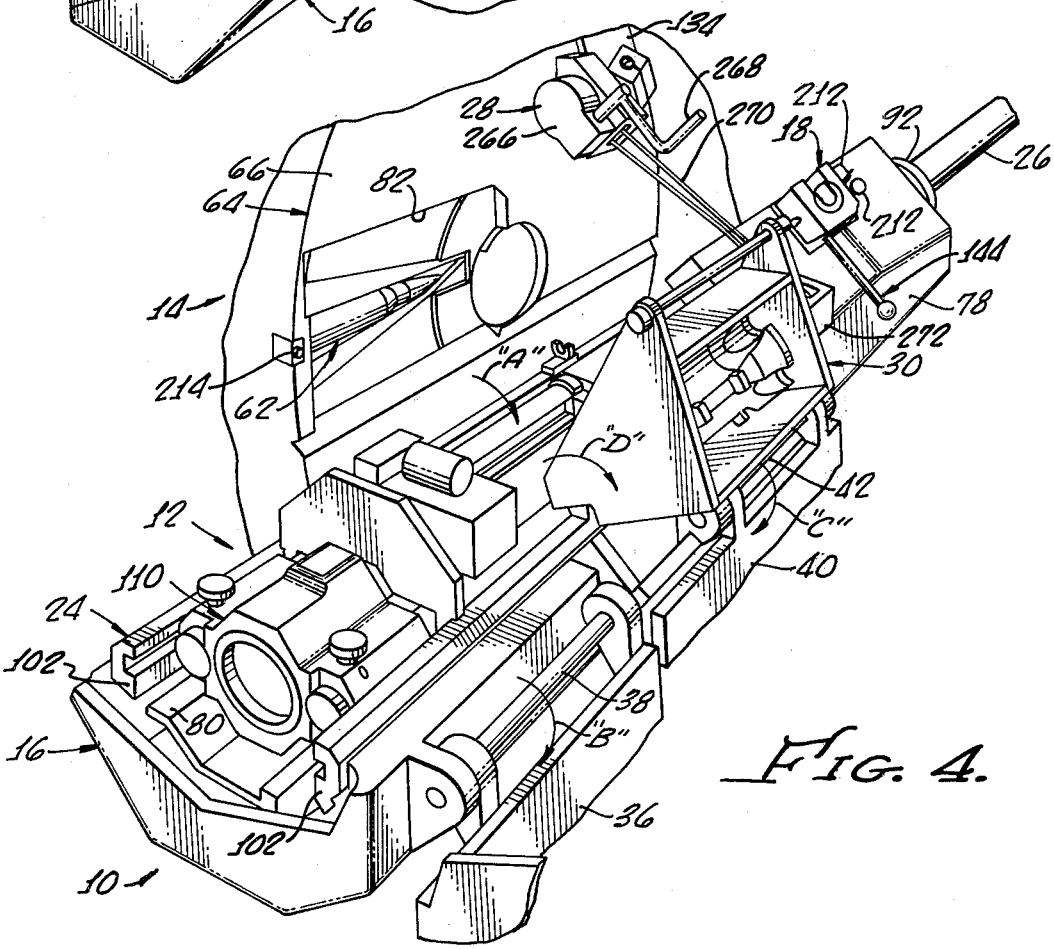
FIG. 4.

FOLDOUT CRADLE APPARATUS FOR MOUNTING AN AUTOMATIC CANNON TO A TURRET EXTERIOR

The present invention relates to weapons systems employing automatic cannon and more particularly to apparatus for mounting cannon to the exterior of a anti-aircraft turret.

Anti-aircraft weapons systems used for defense against low level, close in attack aircraft typically employ automatic cannon in the 20 to 40 mm range. Because of relatively high target speed and relatively short ranges involved, high firing rates and rapid target tracking response is required. Typically, an attacking aircraft flying at somewhat less than mach 1 and at a range of about 2000 meters provides only about a 15 second target. To attain a firing rate of between 1000 and 2000 rounds per minute, as has been found to be effective, anti-aircraft cannon for repelling close-in attack are normally used in pairs. For example, since typical 35 mm anti-aircraft cannon have maximum individual firing rates of about 500–600 rounds per minute, a pair of such cannon provides a combined firing rate in the range considered effective.

Such close in anti-aircraft systems are normally also required to be relatively mobile, since defense roles usually include defense of mobile formations of equipment or troops and rapid shifting between fixed attach targets, such as supply depots, airfields and fortifications.

Thus, typical anti-aircraft weapons systems designed for close in defense include pairs of automatic cannon mounted on self propelled or towed vehicles capable of off-road travel. Since at least a gun sight or target tracking operator and a fire control officer are required to operate the weapons systems and because the weapons systems normally include target tracking and ranging apparatus, a shell magazine and feeder, a fire control system and gun drive apparatus, some type of weapons systems enclosure is ordinarily provided.

For some types of air defense systems, the enclosure may comprise a completely closed and armored turret providing protection for the gun crew and weapons system against enemy attack. Armored turrets are usually mounted on a tank chassis so that transport system protection is also provided.

In other types of air defense systems, unarmored turrets or cupolas, which may be partially open, are employed. Although not having the protection against attack afforded by tank mounted turret systems, very substantial advantages of increased transport mobility and speed are provided, because of much lighter system weight.

Regardless of the type system, designers must choose between mounting the cannon inside the turret or on outer side surfaces thereof. Several advantages are obviously associated with mounting the cannon inside the turret. For example, at least when the turret is armored, the cannon and the crew are protected against attack. Furthermore, with the crew and cannon both inside the turret, working portions of the cannon may be accessible so that, in combat conditions, gun jamming or other malfunctions can be easily corrected without exposure of the crew to enemy fire.

However, various disadvantages are also associated with mounting anti-aircraft cannon inside a turret. A principle disadvantage is the size of a turret sufficiently large to contain receiver portions of a pair of large calibre cannon and to permit the full 90° cannon elevation required for anti-aircraft systems. Large turret size is particularly disadvantageous if the turret is armored, since the turret then becomes extremely massive, adversely affecting system mobility speed, range, off-road capability and ammunition carrying capacity. Even if the turret is unarmored, increasing turret size to accommodate internally mounted cannon has similar adverse affects on those systems requiring light weight or high mobility. For non-mobile systems, such as fixed emplacement turrets, large turret size and mass are still a disadvantage, since rapid, precise turret rotational movement for aiming the cannon becomes increasingly more difficult as the mass to be rotated increases.

Another problem associated with internally mounted cannon is maintaining the turret operationally free from smoke and noxious gasses caused by firing. Complicated sealing or exhaust systems are required to prevent smoke and gasses in the turret from exceeding levels hazardous to the crew or from adversely affecting crew performance. The sealing or exhaust systems not only increase complexity and weight of the weapons system, but also generally restrict access to the cannon, thereby eliminating a principal advantage of internal gun mounting.

For these and other reasons, external turret mounting of anti-aircraft cannon appears generally preferred, at least for mobile weapons systems. An example of this type of system is the European tank mounted, Oerlikon-Contraves 35 mm anti-aircraft system, commonly known as the Flackpanzer.

However, mounting of anti-aircraft cannon to external sides of a turret also has several disadvantages. One disadvantage is that because the two cannon are mounted relatively far from the azimuth rotational axis, uneven recoil forces caused by typically non-synchronous firing, and to a much greater extent by firing of only one cannon, as is sometimes the situation, cause high turning moments on the turret. This tends to increase the difficulty of precise azimuth rotational control of the turret.

Another disadvantage is that since the cannon are typically mounted in closed cradles fixed to the turret, cannon access is ordinarily quite restricted. Ready access to the cannon, for such routine maintenance as cleaning and greasing moving parts, is, however, essential to ensure reliable combat operation, since only if the cannon are readily accessible is adequate inspection and preventive maintenance performed, with malfunctions during operation minimized. Restricted cannon access also makes clearing of jammed conditions extremely difficult in combat.

Associated with both internally and externally mounted cannon is the problem of bore sight adjustment of the cannon, so that both of the pair aim towards a common point at a preselected range. Also, cannon must actually aim at whatever point is indicated by the angular positional indicators which feed cannon aiming information to the fire control computer. Gun bore sight adjustments must be easily and accurately accomplished and must be maintained thereafter during operation and servicing of the cannon.

Towards solving problems associated with access to, and bore sighting of, externally mounted cannon used in air defense weapons systems, applicant has invented a hinged cannon supporting cradle which not only provides ready access to the cannon, but also enables easy, accurate positional adjustment of the cradle relative to associated turret to bore sight a cannon mounted in the cradle.

Thus, for a weapons system which includes a gun turret having an exposed gun mounting member pivotally mounted on an elevational axis and at least one automatic cannon, cradle apparatus for externally mounting the cannon to such member comprises, according to the present invention, a rigid, cannon cradle having first, second and third mounting means, arranged in a triangular configuration, for mounting the cradle to the member for pivotal cradle movement between closed and open positions. Means for mounting the cannon in the cradle for access thereto when the cradle is pivoted to the open position are included, as are latching means in the first mounting means for releasably latching the closed cradle to the gun mounting member. The second and third mounting means include hinging means which define a cradle hinge line and enable the cradle to pivot thereabout between the closed and open positions when the latching means is unlatched.

Additionally, the cradle mounting means include adjusting means for enabling the cradle to be adjustably positioned relative to the gun mounting member about elevational and azimuthal axes for bore sighting of the cannon mounted in the cradle. To enable such cradle positional adjustment, the cradle mounting means each include cradle portions fixed to the cradle and turret portions fixed to the mounting member and adjustable universal connecting means therebetween comprising universal, ball and socket joints. The universal joint portions of the second and third mounting means comprise the cradle hinging means.

More specifically, the universal connecting means of the first and second mounting means are positioned and oriented, relative to the cradle and the gun mounting member, to define a bore sight azimuth adjustment axis, which is generally orthogonal to a barrel bore axis through the cannon and is in a vertical plane, when the gun mounting member elevation axis is horizontal. In addition, the universal connecting means of the third mounting means is positioned and oriented relative to the cradle and the member to define a bore sight elevation axis which is parallel to the member elevation axis.

The adjusting means of the first, second and third mounting means include the associated universal connection means and means enabling positional adjustment thereof. Thus, pivotal movement of the cradle relative to the gun mounting member about the bore sight elevational axis is by positionally adjusting the universal connecting means of the first and second mounting means. Positionally adjustment of the universal connecting means of the third mounting means causes pivotal azimuthal movement of the cradle relative to the gun mounting member, about the bore sight azimuth axis.

Comprising the latching means of the first cradle mounting means is the socket portion of the universal connecting means, the socket being formed with a ball receiving side opening. Mounting of the latching socket is such that when the cradle is closed and the associated ball is received into the socket through the socket open side and the socket is pivoted to a latching position, the ball cannot be withdrawn by pivotal movement of the cradle about the hinge line and hence the closed cradle cannot be opened. Detent locking means are provided for releasably maintaining the socket in the latched position. Electrical interconnect means are provided for preventing firing of the cannon when the cradle is not latched in a closed condition, so as to prevent possible recoil caused damage.

Configuration of the cannon mounting means is such that when the cradle is closed, a transverse plane of the cannon is at an angle of about 45° with the vertical. Thus, when the cradle pivots from the closed condition through about 45° to an open position, the cannon is relatively accessible. Shell feeding means are pivotally mounted to the cannon mounting means for enabling the feeding means to fold out for additional cannon accessability.

Also included in the cradle apparatus are means for assisting pivotal movement of the cradle between the closed and open positions, such means including a manually operated winch.

A better understanding of the present invention may be had from a consideration of the following detailed description, taken in conjunction with the accompanying drawings, in which:

FIG. 3 is a perspective view of the cradle apparatus, showing a cradle portion thereof closed relative to the gun mounting plate;

FIG. 4 is a perspective view of the cradle apparatus, similar to that of FIG. 3, but showing the cradle pivoted to an open position;

Figure 1:
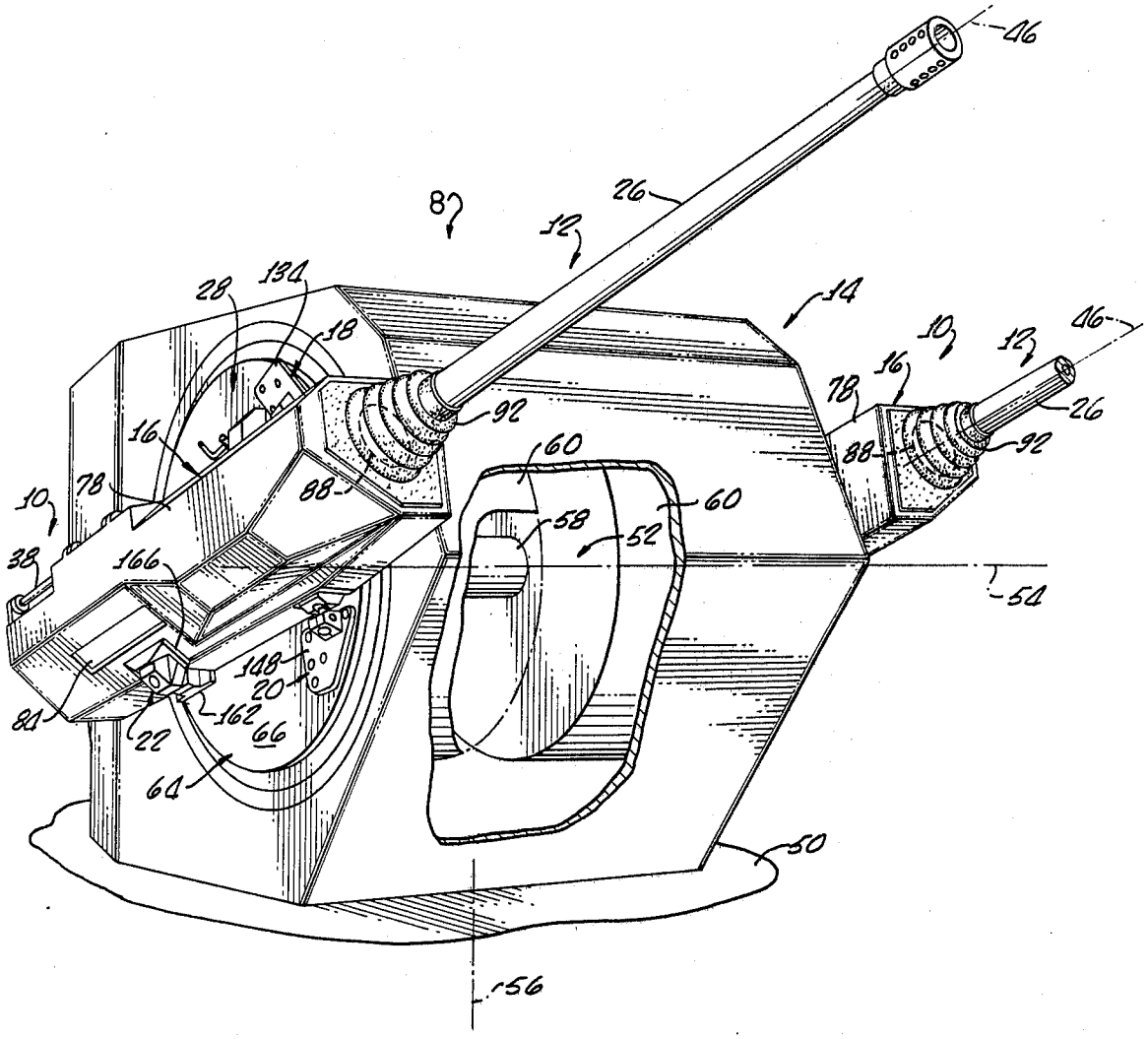
FIG. 1 is a partially cutaway, perspective drawing of an exemplary air defense weapons system turret or cupola, to opposite exterior sides of which are mounted cannon cradle apparatus according to the present invention.
Figure 2:
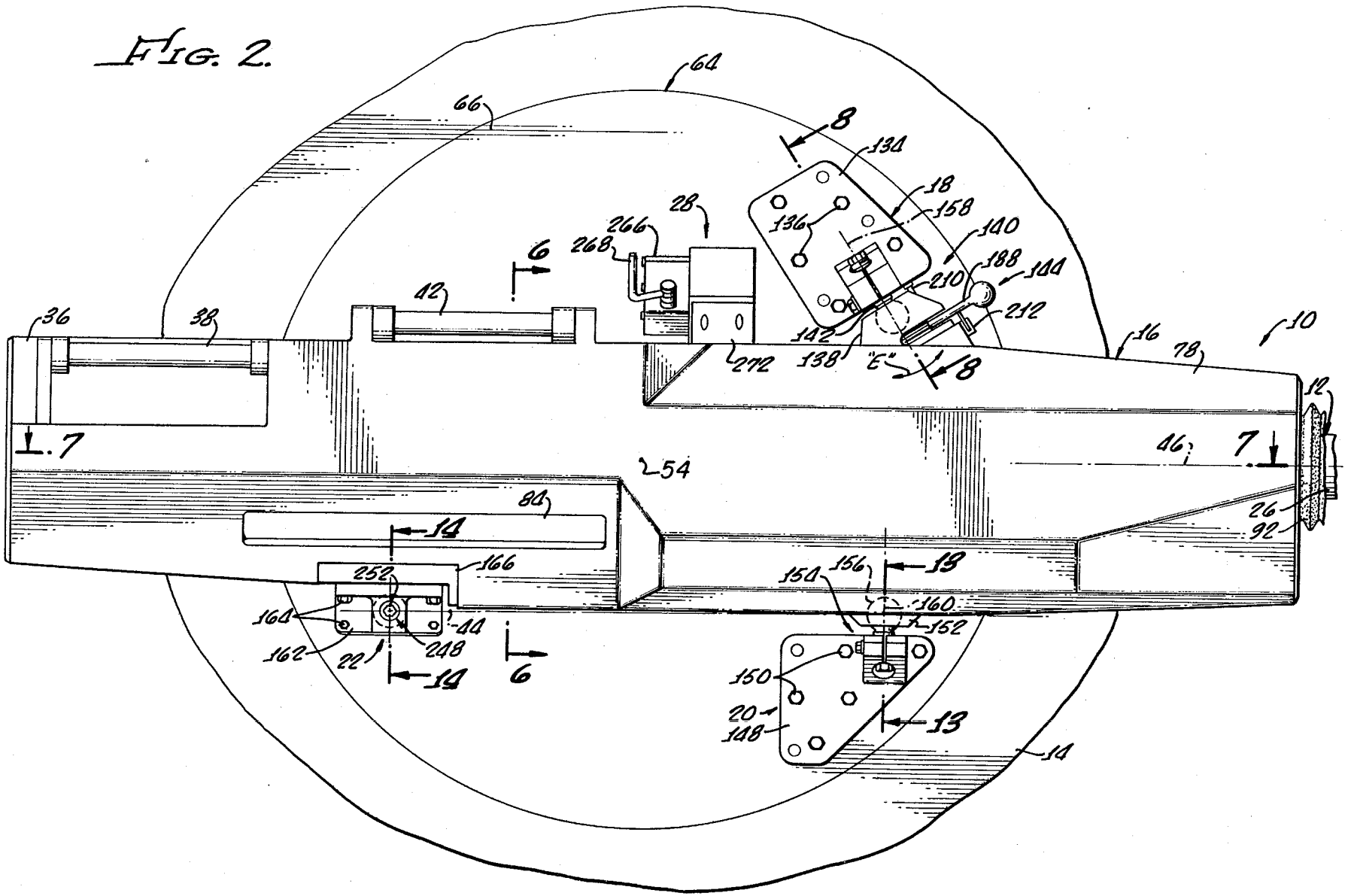
FIG. 2 is a side elevational view of a typical one of the cannon cradle apparatus of FIG. 1, showing first, second and third cradle mounting means mounting a cradle portion of the apparatus to a gun mounting plate of the turret.

Shown in FIGS. 1-4 are portions of an exemplary weapons system 8, for example an anti-aircraft system, in which a pair of cannon cradle apparatus 10, according to the present invention, are employed to pivotally mount a pair of automatic cannon or guns 12 to opposite exterior sides of a turret or cupola 14. Generally comprising each of the cradle apparatus 10 (only a typical one of which is shown in FIGS. 2–4) is a rigid, elongate box-like cradle 16 having associated therewith first, second and third, universal-type cradle mounting means 18, 20 and 22, respectfully, for mounting the cradle 16 to the turret 14.

Included in each of the cradle apparatus 10 are internal cannon mounting means 24 (FIG. 4) for mounting the cannon 12 in the cradle 16 with a barrel 26 projecting forwardly therefrom. Assist means 28, shown to be of a manual winch type, are provided for controlling pivotal movement of the cradle 16, relative to the turret 14, between closed and open positions. Shown in FIG. 4, but not part of the present invention, are cannon shell feeding means 30 which are pivotally mounted to the cannon mounting means 24 in operative relationship with the cannon 12.

Access to the cannon 12, when the cradle 16 is in an open position, is further enabled by a first, rearward access door or panel 36 pivotally mounted to cradle structure by a longitudinal first pin 38, and by a forwardly adjacent second access door or panel 40, in the region of the feeding means 30, pivotally mounted to cradle structure by a second, longitudinal pin 42.

As is more particularly described below, the first cradle mounting means 18, positioned upwardly and forwardly on the cradle 16, are particularly configured for enabling latching of the cradle 16 to the turret 14 when the cradle is closed thereagainst. In contrast, the second and third cradle mounting means 20 and 22, which are spaced longitudinally apart on lower regions of the cradle 16, are configured for enabling the cradle to pivot between the closed and open positions about a hinge or pivotal axis 44 defined therethrough (FIGS. 2 and 5). Preferably, the cradle mounting means 20 and 22 and the cradle 16 are configured so that the cradle hinge axis 44 is generally parallel to a barrel bore axes 46 of the cradle mounted cannon 12.

Figure 5A:
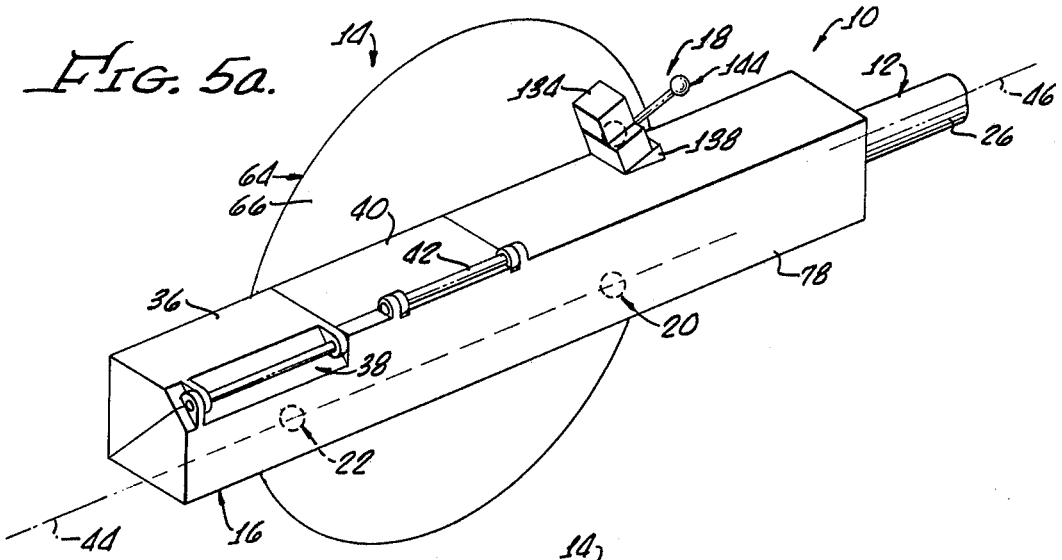
FIG. 5 is a pictorial perspective showing two step, fold out characteristics of the cradle apparatus, FIG. 5(a) showing the cradle in a closed position (similar to FIG. 3), FIG. 5(b) showing the cradle and access doors therein pivoted to an open position (similar to FIG. 4), and FIG. 5(c) showing a shell feeding means opened out for additional cannon access.

Access to the cradle mounted cannon 12 is readily achieved by two stage pivoting or folding our of the cradle 16 and feeding means 30, as sequentially depicted in FIGS. 5(a), (b) and (c), and described hereinafter in greater detail. Thus, FIG. 5(a), as well as FIGS. 1–3, depicts the cradle 16 initially closed against the turret 14, with the cannon 12 in readiness for firing.

Figure 5B:
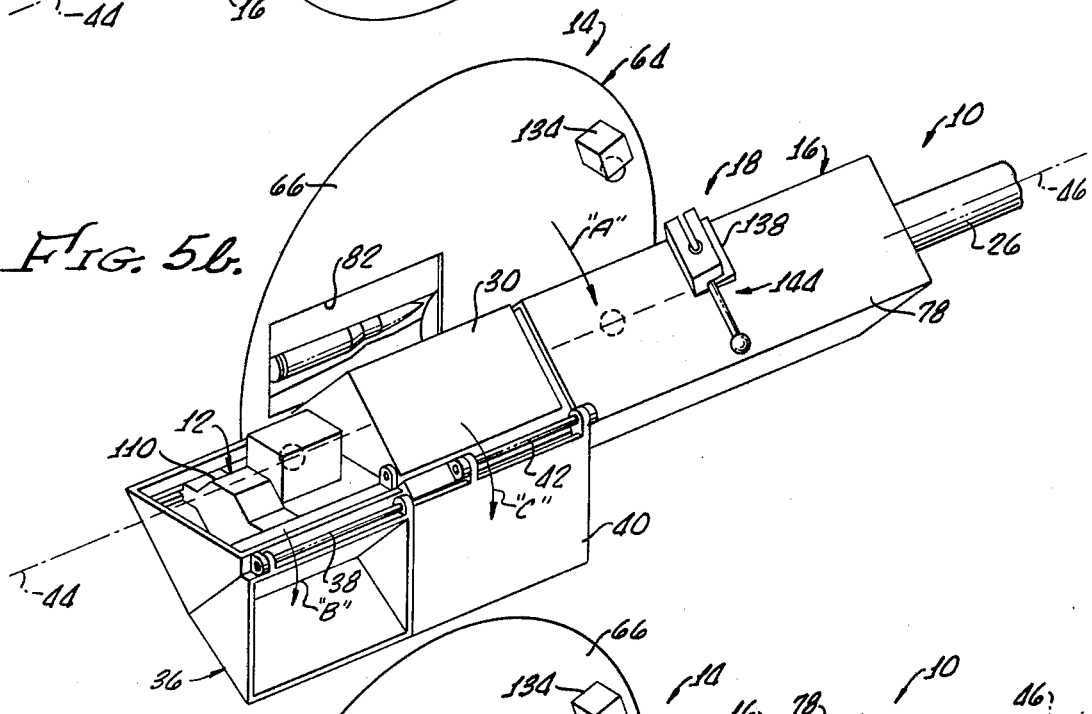

After unlatching the first cradle mounting means 18 and in a first pivoting stage (FIG. 5(b)), the cradle 16 is pivoted (direction of Arrow "A") about the hinge axis 44 through approximately 45° to a fully open position. When in this open position, the access doors 36 and 40 may also be pivoted open (direction of Arrows "B" and "C", respectively). Rear portions of the cannon 12 are then exposed for maintenance or repair.

Figure 5C:
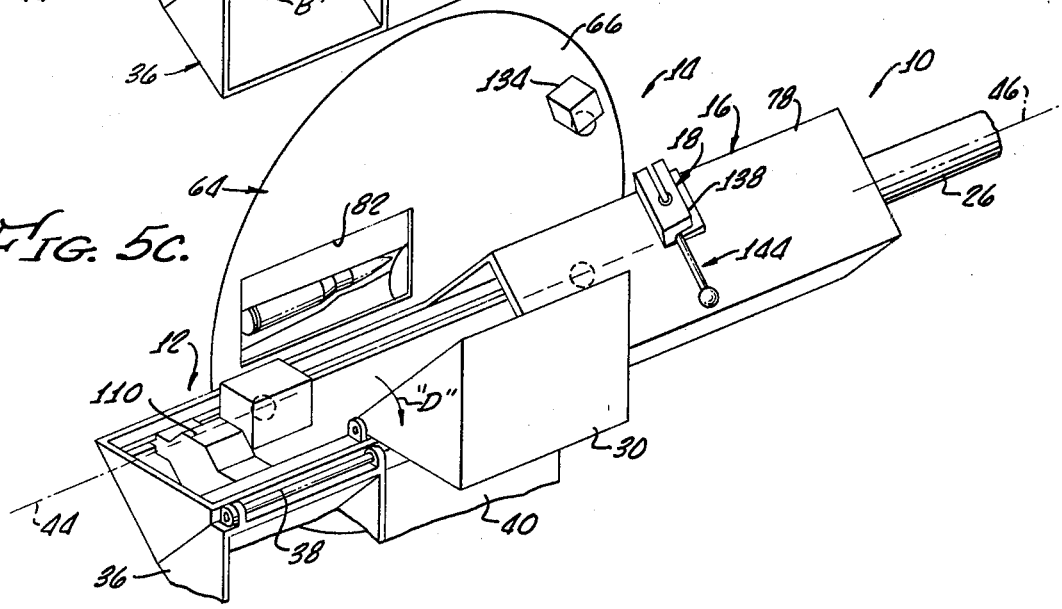

In the second pivoting stage (FIGS. 5(c) and 4), the feeding means 30 is pivoted approximately 90° outwardly (direction of Arrow "D") from the open cradle to enable access to other portions of the cannon 12 and to interior portions of the feeding means not otherwise easily accessible. Thus, for example, jammed or unfired shells in the feeding means 30 may be easily removed from the cannon 12 or the feeding means.

Additionally, and very importantly, the cradle mounting means 18, 20 and 22 are separately configured and positioned to enable sufficient positional adjustment of the closed and latched cradle 16, relative to the turret 14, for bore sighting of the cannon 12, also as described below.

For illustrative purposes, the associated turret 14 is shown to be an unarmored, and hence comparatively lightweight, open cupola-type, of a type particularly advantageous for highly mobile weapons systems. However, it is to be appreciated that the cradle apparatus 10 is adaptable for externally mounting guns to virtually any type of turret, including closed and armored turrets of the type ordinarily mounted on tank chasis or to fixed installations. As shown, the turret 14 is rotatably mounted to an associated mounting platform or deck 50 (FIG. 1) for azimuth gun aiming by conventional drive means (not shown).

For the turret 14 illustrated, elevational cannon aiming movement is caused by elevating means 52, to which the two cradle apparatus 10 are fixed, by the mounting means 18, 20 and 22, for simultaneous pivoting about a normally horizontal elevation axis 54. In turn, the axis 54 rotates in azimuth with the turret 14, about a normally vertical axis 56.

Included in the elevating means 52 may be a torque tube 58, an axis of the torque tube being on the elevation axis 54. Disposed around the torque tube 58 are shown drum-type magazines 60 each having an internally mounted, rotatable, segmented shell magazine 62 (FIG. 4) from which shells are fed to the associated cannon 12. Interconnected by the torque tube 58 are large circular, rigid end plates or cradle mounting members 64 to which the cradles 16 are mounted, shells being fed through the members 64 to the cannon. These cradle mounting members 64 have a generally flat cradle mounting surface 66 and are bearing mounted to sides of the turret 14 for elevational rotation about the axis 54.

When mounted to the members 64, the two cradles 16, and hence the cannon 12 mounted therein, are rigidly interconnected through the torque tube 58. Elevational movement of the two cannon 12 in unison is enabled by the elevating means 52, which include elevational drive means (not shown) which may be generally conventional in nature and which may be connected to the torque or either or both of the cradle mounting members 64.

More particularly described, and as best seen in FIGS. 2–4 and 6, the cradle 16 comprises an elongate, rigid structure. Cross section of the cradle structure longitudinally varies, as is necessary to accommodate the cannon 12 and other portions of the weapons system, such as cannon charging apparatus (not shown), which may also be installed in the cradle. It should be understood however, that cradle structural configuration also depends upon particular cradle and weapons system criteria, such as size, weight and the extent of cannon protection to be provided by the cradle. Thus, for example, instead of being substantially closed as shown, the cradle 16 may alternatively comprise a partially open framework (not shown), if less cannon environmental protection is required. However, regardless of configuration, the cradle 16 is constructed sufficiently strong and rigid that when in a closed and latched condition, reaction forces caused by firing the cannon 12 are safely transmitted through the cannon mounting and cradle mounting means 24, 18, 20 and 22 and into the member 64, and hence into the turret 14, without damage, and without such permanent or instantaneous deflection, relative to the turret, as to adversely affect weapon system accuracy.

To achieve the strength and rigidity required for mounting such larger cannon as 35 mm types, while minimizing weight, the cradle 16 is constructed having a welded, load carrying rigid metal skin or shell 78, to which portions of the cradle mounting means 18, 20 and 22 are fixed. The cradle 16 also has an internal framework 80 (FIG. 6) to which the cannon mounting means 24 and shell 78 are fixed.

Access to rearward, receiver portions of the cannon 12, when the cradle 16 is open, is enabled by constructing those rearward portions of the cradle shell 78 abutting the mounting member 64 to be substantially open. During operation with the cradle closed, the cradle 16 is enclosed in this region by the access doors 36 and 40, except to the extent required for feeding of shells from the turret magazine 60, through a feed port 82 in the member 64, into the feeding means 30.

In appropriate alignment with a corresponding cannon shell ejection port (not shown), an ejection port 84 (FIGS. 1 and 6) is formed in lower, rearward regions of the cradle shell 78 to enable ejection of fired shell casings outwardly through the cradle 16. An opening 88 formed in a forward end wall of the cradle shell 78 enables the cannon barrel 26 to project forwardly therethrough. Open regions between the barrel 26 and the opening 88 are preferably sealed by an accordian-type, flexible dust boot 92, as is shown in FIG. 1.

For the exemplary cannon 12 illustrated, which is shown to be the open framework receiver-type described in U.S. Pat. No. 4,269,109, issued May 26, 1981, to Eugene M. Stoner, the cannon mounting means 24 comprises an opposed pair of elongate, rigid tracks 102 (FIGS. 6 and 7) longitudinally fixed to the cradle framework 80. Formed along each of the tracks 102 is a rectangular recess 104 (FIG. 6) for slidably receiving longitudinally separated, transverse pairs of sidewardly projecting mounting lugs on the cannon 12. As shown in FIG. 7 for illustrative purposes, these mounting lugs include lugs 108 on a cannon recoil buffer 110, lugs 112 on a breech ring 114, rearward and forward lugs 116 and 118 on cannon recoil means 120 and lugs 124 on a forward barrel support 126. A pair of pins 128 installed through the rearward lugs 116 fix the cannon recoil means 120 to the tracks 102, thereby enabling the rest of the cannon 12, after firing, to recoil and counterrecoil along the tracks to an extent controlled by springs (not shown) in the recoil means 120. Accordingly, for the type cannon 12 shown, the entire firing reaction forces, which are several thousand pounds for a 35 mm cannon, are transmitted to the tracks 102, and hence to the cradle 16 and ultimately the turret 14, through the pins 126.

Figure 6:
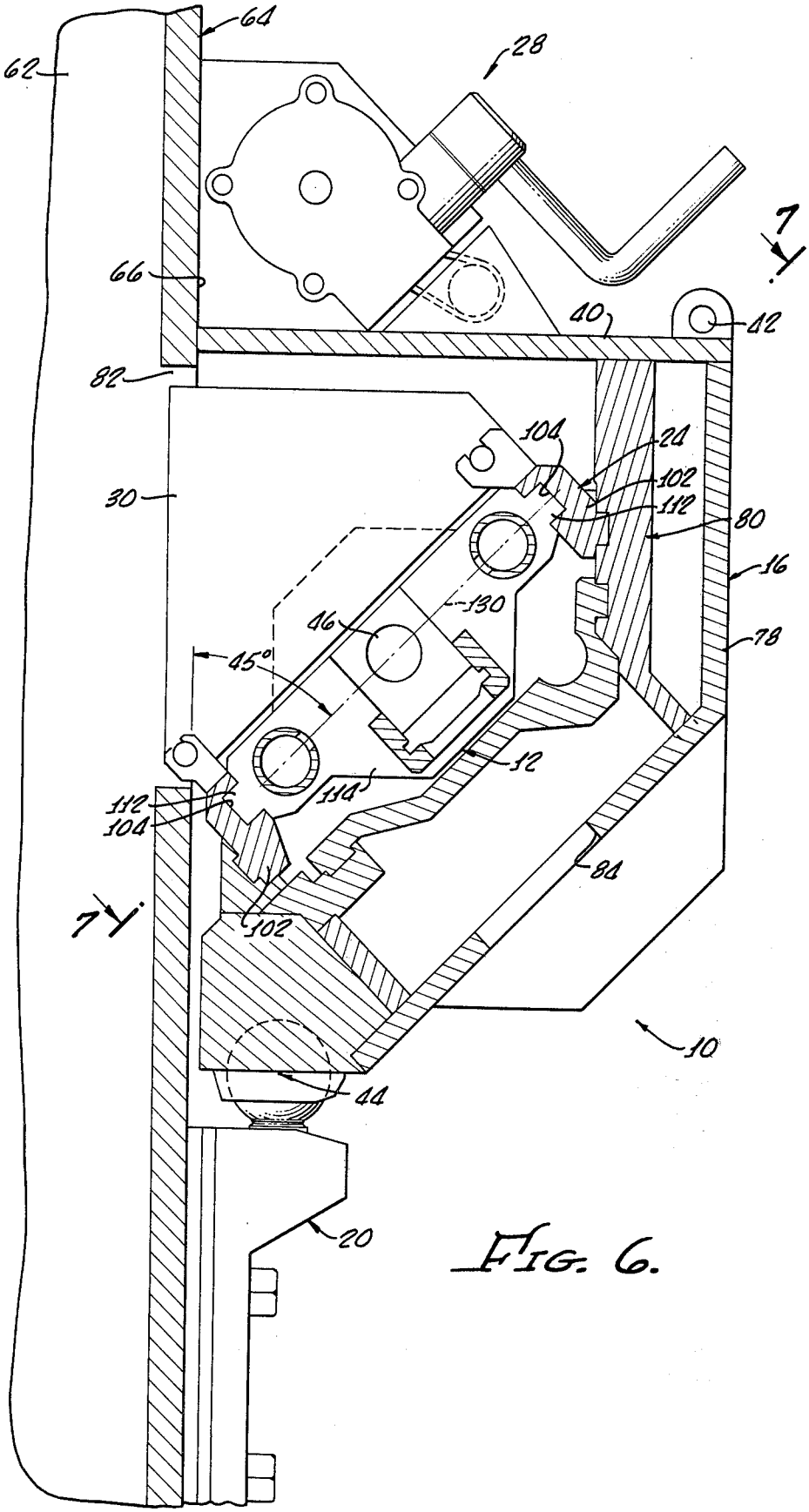
FIG. 6 is a vertical sectional view, taken along line 6—6 of FIG. 2, showing internal features of the cradle.
Figure 7:
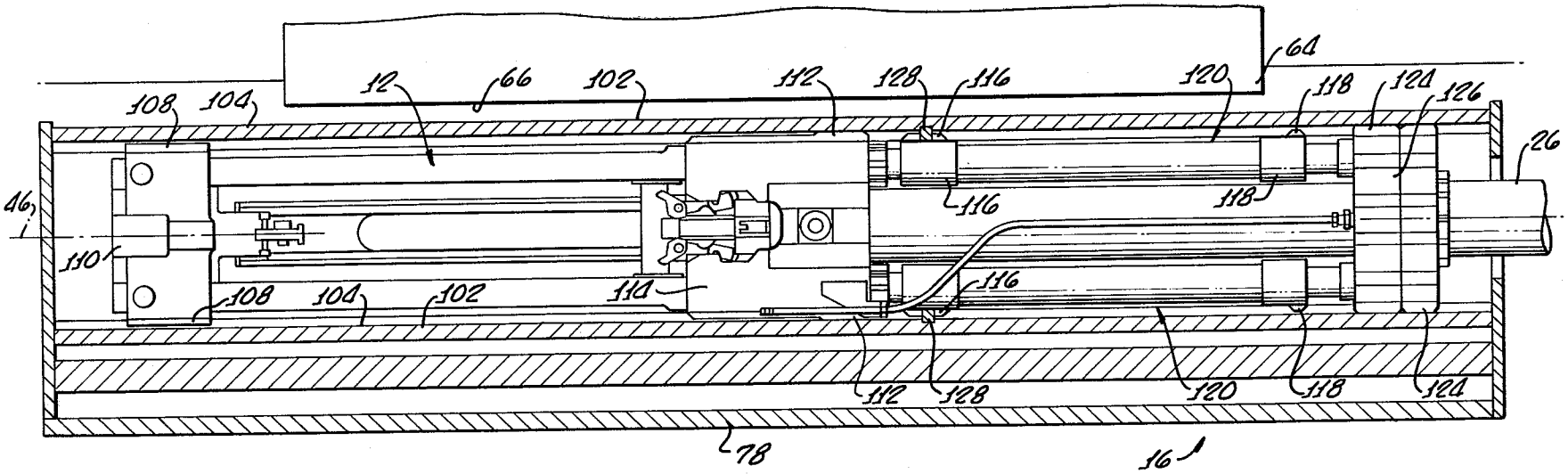
FIG. 7 is a sectional view, taken along line 7—7 of FIG. 6, showing means for mounting the cannon in the cradle.

Orientation of the tracks 102 relative to the cradle 16, as also seen in FIG. 6, is such that when the cradle is closed, a transverse plane 130 through the cannon is at an angle of about 45° to the member face 66. This 45° angle, which corresponds to, and is dependent upon, the angle through which the feeding means 30 feeds shells from the magazine 60 into the cannon 12, causes the cannon plane 130 to be horizontal, for easy cannon access, when the cradle is pivoted through about 45° from the closed to the fully open position.

It is to be appreciated that the cannon mounting means 24 may, however, be varied according to the particular cannon configuration for which the cradle apparatus is to be used. Thus, the particular cannon mounting means 24 associated with the cannon 12 is shown and described for illustrative purposes only, with no limitations thereby implied or intended.

Configurations of the cradle mounting means 18, 20 and 22 are similar to one another to the extent that each includes cradle and turret end plate portions. Each also includes a ball and socket-type universal connection or joint assembly, which pivotally interconnects the cradle and end plate portions and which enable opening and closing of the cradle as well as bore sighting of the cannon 12, as described below.

Depending upon configuration of the cannon 12 and the turret member 64, the cradle mounting means 18, 20 and 22 are preferably fixed to the cradle 16 at positions approximately equally distant from a center of cannon gravity, which is, in turn, preferably located at about the cradle center of gravity. Furthermore, the cradle 16 is preferably mounted to the end plate 64 with the center of cannon and cradle gravity generally coincident with the cannon elevational axis 54. With the center of cannon and cradle gravity coincident or closely adjacent to the elevational axis 54, elevational movement of the cannon 12 is subject to accurate control. To provide strong and rigid cradle-to-end plate or member attachment, the cradle mounting means 18, 20 and 22 are spaced as far apart on the cradle 16 as diameter of the member 64 permits. As an illustration, assuming the member 64 is about four feet in diameter, the lower mounting means 20 and 22 are spaced apart about 2½ feet.

Included in the first cradle mounting means 18, as seen in FIG. 2, is a turret or end plate portion 134 fixed to the member 64 in an upper forward region thereof (when the barrel bore axes 46 is horizontal) by several bolts 136. A cradle portion 138 of the first mounting means 18, which includes socket portions of universal connecting means 140, is fixed to the cradle 16. Interconnecting the plate portion 134 with the cradle portion 138 is a shaft mounted ball 142 which is adjustably fixed to the plate portion 134 and which is also part of the connecting means 140, as more particularly described below. The cradle portion 138 also includes cradle latch means 144, also described below.

In a similar manner, the second cradle mounting means comprises a turret or end plate portion 148, fixed by bolts 150 to a lower forward portion of the member 64, a cradle portion 152 fixed to an underside of the cradle shell 78 and universal connecting means 154 which interconnect the plate and cradle portions. Socket portions of the connecting means 154 are included in the cradle portion 152 for receiving a shaft mounted ball 156 fixed to the plate portion 148.

For the first and second cradle mounting means 18 and 20, respective axes 158 and 160 of the shaft mounted balls 142 and 156 lie in a common plane parallel to the end plate surface 66, thereby enabling elevational bore sight adjustment of the cannon 12 as hereinafter described.

Comprising the third cradle mounting means 22, is a plate cradle portion 162, fixed by bolts 164 to a lower, rearward portion of the member 64 (FIG. 2), and a cradle portion 166 fixed to an under surface of the cradle shell 78. As more particularly described below, a shaft mounted ball (not shown in FIG. 2) fixed to the cradle portion 166 has a shaft axis orthogonal to the end plate surface 66 for enabling azimuthal bore sight adjustment of the cannon 12.

Figure 12:
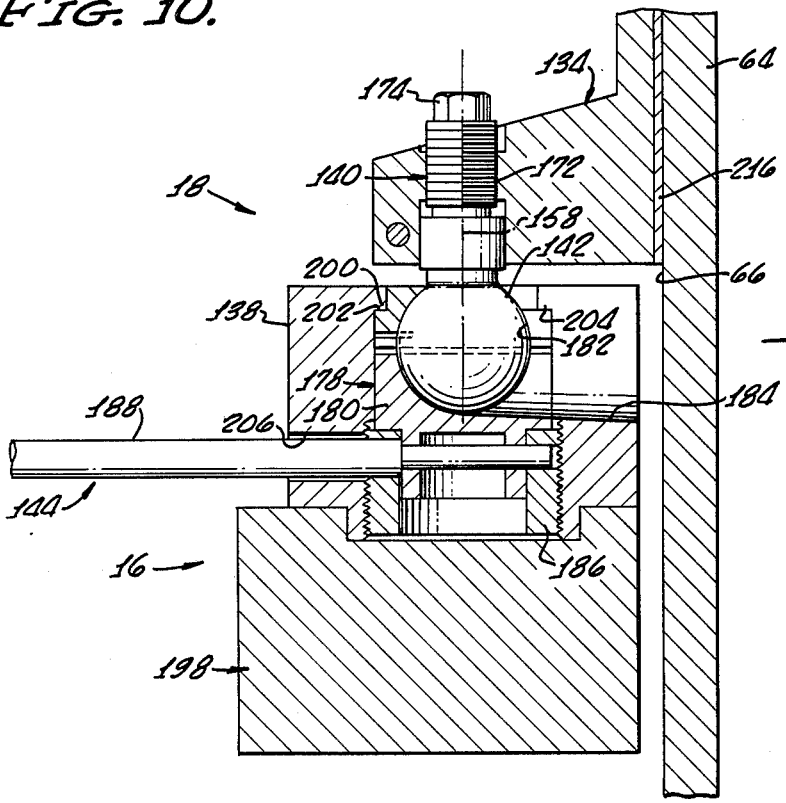
FIG. 12 is a sectional view taken at a right angle to that of FIG. 8, showing the first cradle mounting means in a unlatched condition.

More specific aspects of the first cradle mounting means 18 are seen in FIGS. 8–12, FIGS. 8–11 showing such mounting means in a latched and locked condition and FIG. 12 showing such mounting means in an unlatched condition enabling cradle opening.

Figure 8:
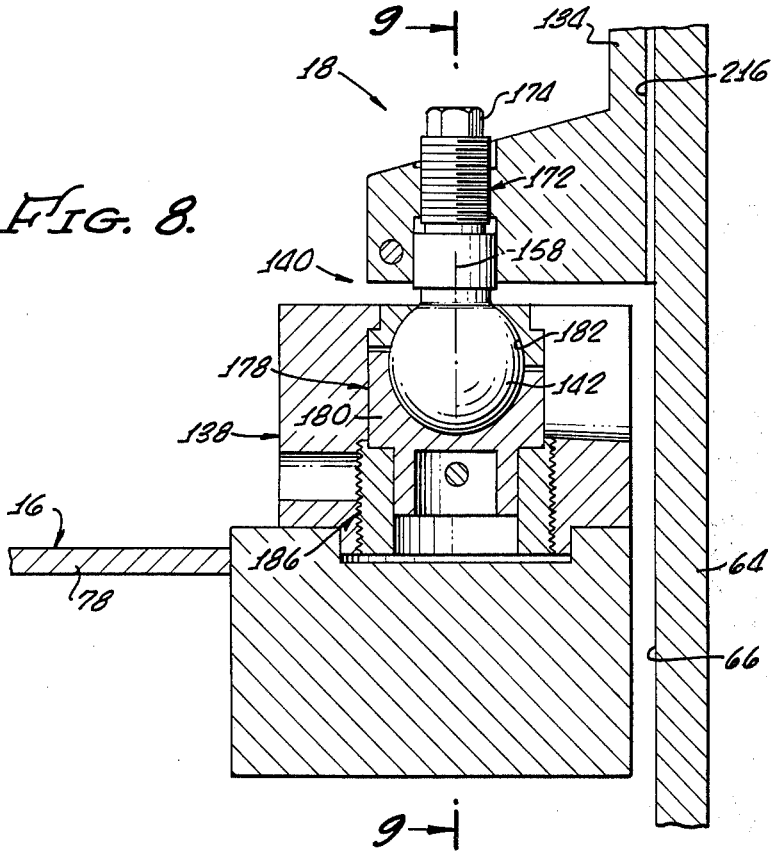
FIG. 8 is a sectional view, taken along line 8—8 of FIG. 2, showing features of the first cradle mounting means.
Figure 9:
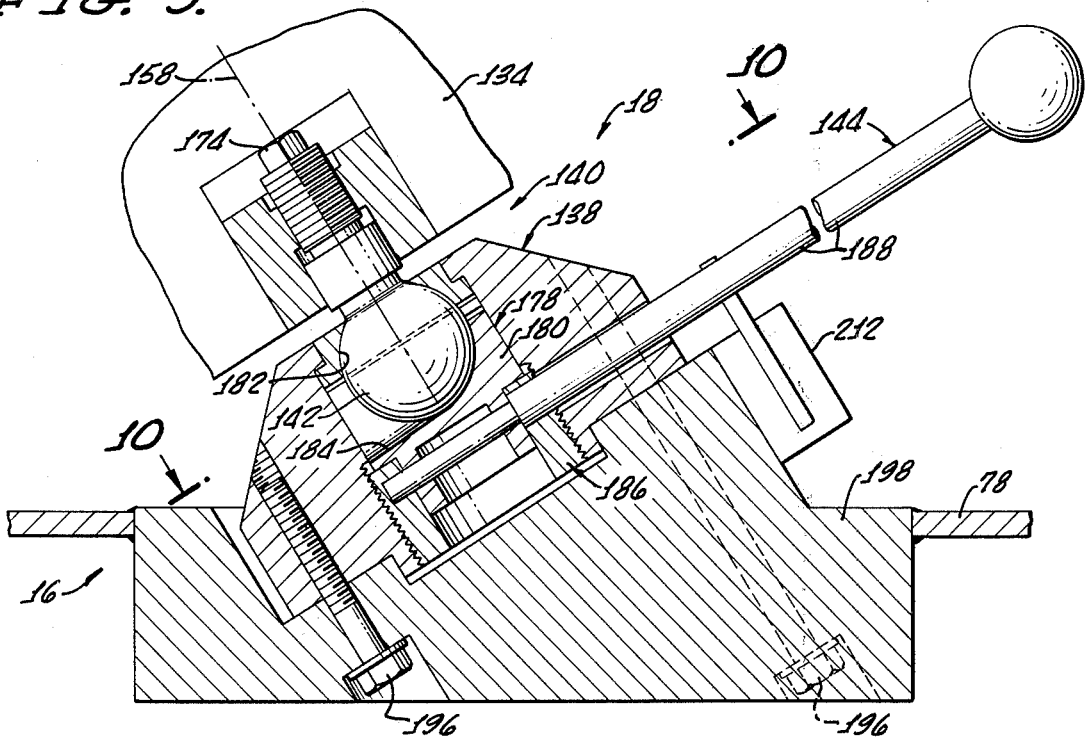
FIG. 9 is a sectional view, taken along line 9—9 of FIG. 8, showing latching portions or the first cradle mounting means.
Figure 10:
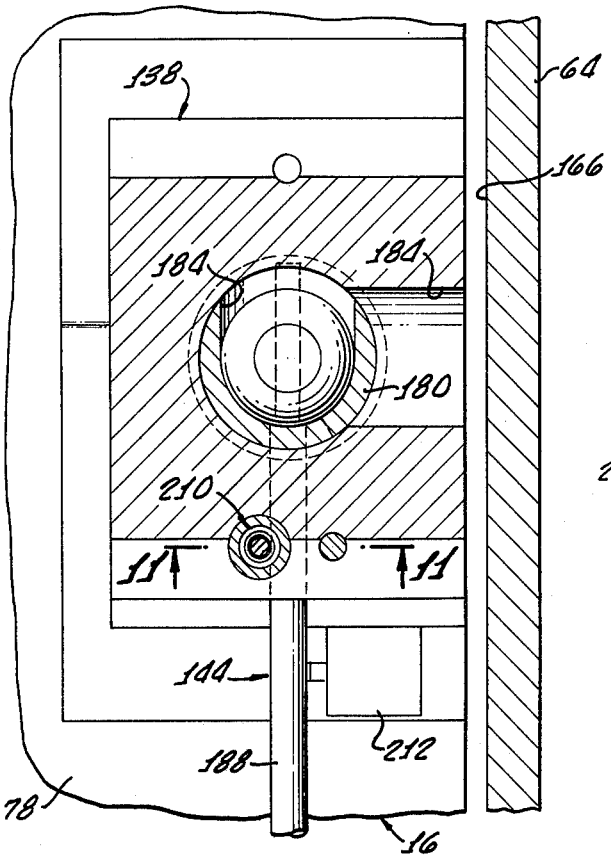
FIG. 10 is a sectional view, taken along the line 10—10 of FIG. 9, showing the latching portion of the first mounting means in a latched condition for latching the cradle closed.
Figure 11:
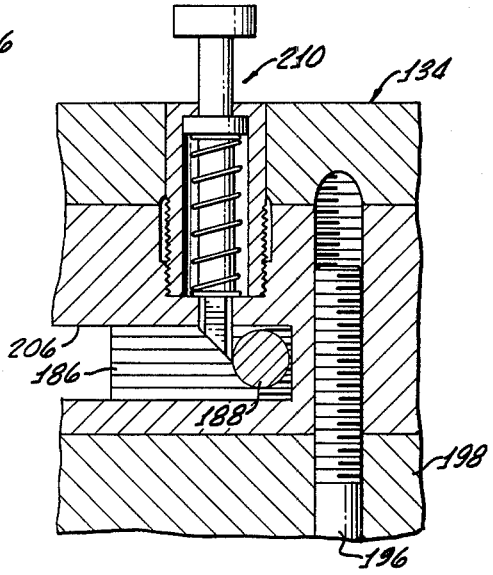
FIG. 11 is a sectional view, taken along line 11—11 of FIG. 10, showing detent locking of a latching handle in the latched condition.

As seen in FIG. 8, a shaft 172 to which the ball 142 of the means 18 is fixed, is threadably installed in the plate portion 134 with the shaft axis 158 parallel to the surface 66. Turning an exposed shaft end 174 enables movement of the ball 142 in either direction along the axis 158 to enable positional adjustment of the cradle portion 138 (and hence the cradle 16) relative to the corresponding plate portion 134 for cannon bore sight elevational adjustment.

Threadably installed in the cradle portion 138 is a socket assembly 178, which includes a partially circumferentially split socket 180 having a spherical inner wall 182 defining a cavity into which is received the ball 142 and having an open side region 184 (FIG. 9) for admitting the ball into the socket. Also included in the socket assembly 178, and forming part of the latch means 144, is an externally threaded collar 186 into which lower regions of the socket 182 extend and a latch handle 188 which extends radially through both the collar and socket. The cradle portion 138 in which the socket assembly 178 is received is fastened by bolts 196 to a structural cradle fitting 198.

In operation, when the cradle 16 is pivoted to a closed condition against the end plate 64, the handle 188 is positioned in an unlatched orientation enabling the socket 180 to receive the ball 142 through the socket side opening 184 (FIG. 12). In this socket unlatched orientation, a narrow annular gap 200 exists between an upper socket surface 202 and an adjacent inner surface 204 of the cradle portion 138.

Pivoting the latch handle 188 90° (direction of Arrow "E", FIG. 2) about the ball shaft axes 158, and in a cradle portion slot 206, to the latched position of FIGS. 8–11 then reorients the socket side opening 184 so that the ball 142 cannot be released from the socket 180 by pivoting the cradle 16 about the hinge axes 44. That is, when the socket 180 is rotated by moving the latch handle 188 to the latched position, the ball 142 is captured in the socket and the cradle 16 cannot be opened. In addition, such 90° handle pivoting axially forces the socket surface 202 against the cradle portion surface 204, thereby axially compressing split upper and lower portions of the socket 180 together, to clamp the ball 142 tightly in the socket. This eliminates any looseness or play in the connecting means 18 which might cause cannon firing inaccuracies or which might result in mechanical wear or damage.

Detent locking of the handle 188 in the latched position, to prevent accidental opening of the cradle 16, is provided by conventional spring loaded detent means 210 (FIGS. 10 and 11), mounted in the path of handle travel. Before the handle 188 can be moved from the latched to the unlatched positions, the detent means 210 must be manually released. In addition, an electric microswitch 212 (FIG. 10) may be installed on the cradle portion 138 in an position for actuation by the handle 188 when the handle is in the latched position. A second, related microswitch 214 (FIG. 4) is mounted to the turret end plate 64 in a position to be actuated when the cradle is in a closed condition abutting the end plate surface 66.

Both the switches 212 and 214 are preferably connected in electrical series with conventional electrical cannon firing means (not shown) so that the cannon 12 cannot be fired unless the cradle 16 is latched in a closed condition. Thus, accidental cannon firing when the cradle 16 is open, which might cause damage to the cradle or the two mounting means 20 and 22 supporting the cradle, or cause injury to crew members working around the open cradle, is prevented. Alternatively, or in addition, the switches 212 and 214 may be connected, in a well known manner, to provide visual or audible indication when the cradle is not closed and latched.

Spacing adjustment between the cradle shell 78 and the member surface 66 is provided by spacer shims 216 installed, as necessary, between the plate portion 134 and the cradle mounting member 64.

Figure 13:
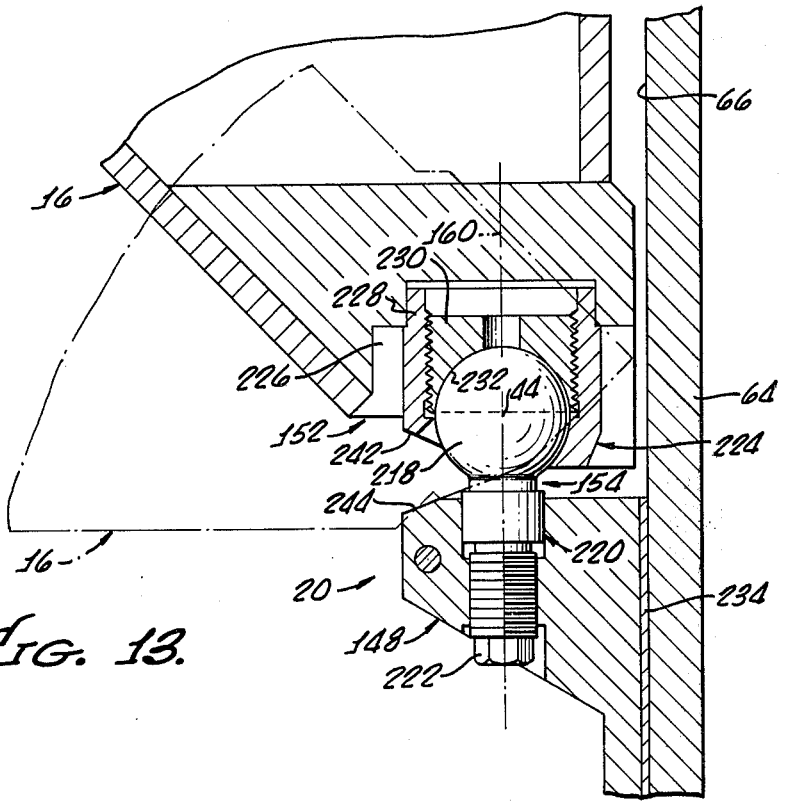
FIG. 13 is a sectional view, taken along line 13—13 of FIG. 2, showing features of the second cradle mounting means.
Figure 14:
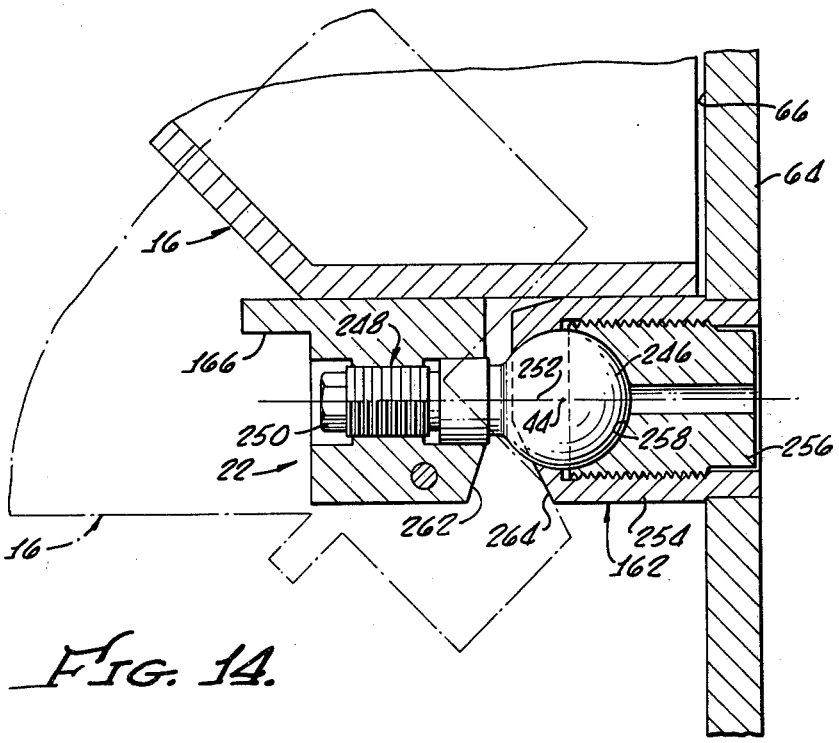
FIG. 14 is a sectional view, taken along line 14—14 of FIG. 2, showing features of the third cradle mounting means.

Features of the second and third, lower cradle mounting means 20 and 22, which are similar to one another, are shown in FIGS. 13 and 14, respectively. The second mounting means 20, as seen in FIG. 13, includes a universal ball 218 fixed to a threaded shaft 220 having an adjusting end 222 by means of by means of which the ball may be moved along the associated axis 160, the shaft being threadably mounted into the end plate portion 148. A corresponding socket assembly 224, into which the ball 218 is received, is fixed to a corresponding cradle structural member 226.

Comprising the socket assembly 224 are outer and inner socket portions 228 and 230. These portions 228 and 230 are threaded together for relative axial adjustment such that an internal wall 232, defining an internal ball receiving cavity, can be axially adjusted to eliminate any looseness in the universal connection 154 caused by manufacturing tolerances or wear. Initial alignment between the cradle 16 and the member 64, on assembly, is enabled by shims 234 which may be installed, as necessary, between the end plate portion 148 and the member surface 66.

When the cradle 16 is in the open condition (as shown in phantom lines) corresponding surface regions 242 and 244 on the cradle and end plate portions 152 and 148, respectively, are brought into abuttment, thereby limiting pivotal opening movement of the cradle.

Formed in a manner similar to the second mounting means 20, the third cradle mounting means 22, as seen in FIG. 14, includes a universal ball 246 fixed to a threaded shaft 248 having an adjusting end 250. The shaft 248 is threadably mounted, for axial adjustment, into the cradle portion 166 so that a shaft axis 252 is parallel to the cradle elevational axes 54 (FIG. 2). The shaft axis 252 is also the cannon bore sight adjustment elevational axis, as discussed below.

The associated end plate portion 162 comprises outer and inner socket portions 254 and 256, respectively. Such socket portions 254 and 256, which correspond to the above described socket portions 228 and 230, include an inner wall 258 defining a cavity into which the ball 246 is received. When the cradle 16 is open (as indicated by phantom lines in FIG. 14) corresponding surface portions 262 and 264 on the cradle and end plate portions 166 and 162 respectively, are brought into abuttment and function as cradle travel stops.

When the first cradle mounting means 18 is unlatched, opening and closing of the cradle 16 is controlled by the assisting means 28, which in the embodiment shown comprise a manually operated cable winch. An operating winch portion 266, having a hand crank 268, is fixed to the member 64 (FIG. 3). A cable 270, operated by the winch portion 266 is entrained over pulley means 272 fixed to a corresponding region of the cradle shell 78.

Although the assisting means 28 is shown to be of a manual hand crank type, it is to be appreciated that, for example, an electrically driven winch or one or more hydraulically actuated cylinders could alternatively be employed for controlling controlling cradle opening and assisting cradle closing.

Three dimensional, bore sighting of the cannon 12, is enabled by adjustably moving the balls 142, 218 and 246 along the respective axes 158, 160 and 252, so as to shift the entire cradle 16 relative to the member 64. At this point it should be recalled that the axes 158 and 160 of the first and second cradle mounting means 18 and 20 are in a common plane parallel to the member surface 66 and are thus orthogonal to the cradle elevational axis 54. The axis 252 of the third mounting means 22 is parallel to such cradle elevational axis, and hence orthogonal to the plane in which the axes 158 and 160 are located.

Figure 15:
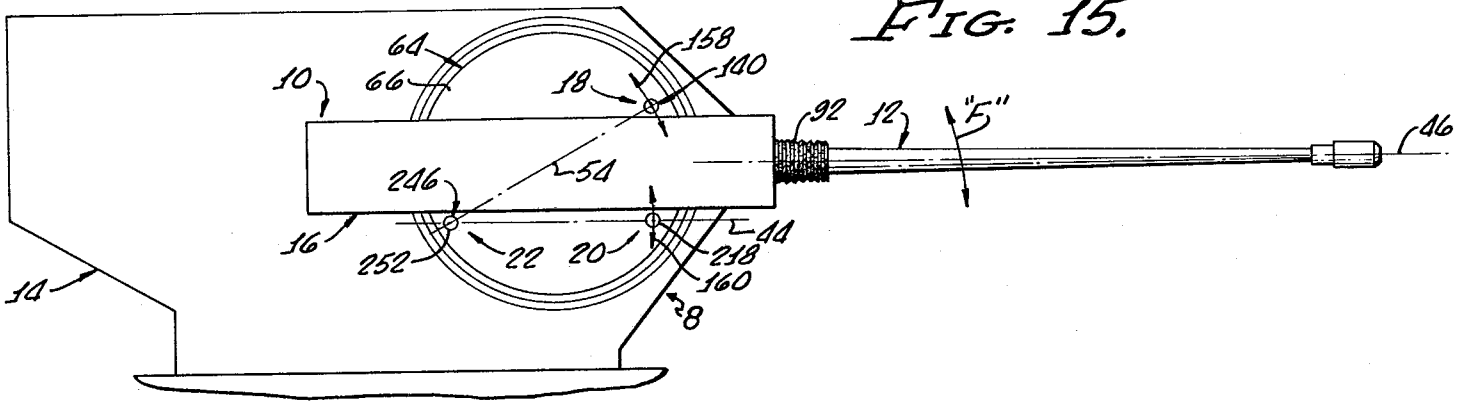
FIG. 15 is a side elevation view, in pictorial form, of the weapons system turret of FIG. 1, showing elevational bore sighting of a cradle mounted cannon.

Angular orientation of the ball shafts 172 and 220 is such that the corresponding axes 158 and 160 are generally on a common arc centered at the axis 252 (FIG. 15). As a consequence, adjustable movement of the ball shafts 172 and 220 in unison and in the same general upward or downward direction causes the entire cradle and cannon 12 mounted therein to pivot about the third ball member axis 252, (direction of Arrow "F"). In this manner, elevational bore sight adjustment of the cannon 12 is provided, the third ball members axis 252 functioning as the bore sight elevational axes.

Figure 16:
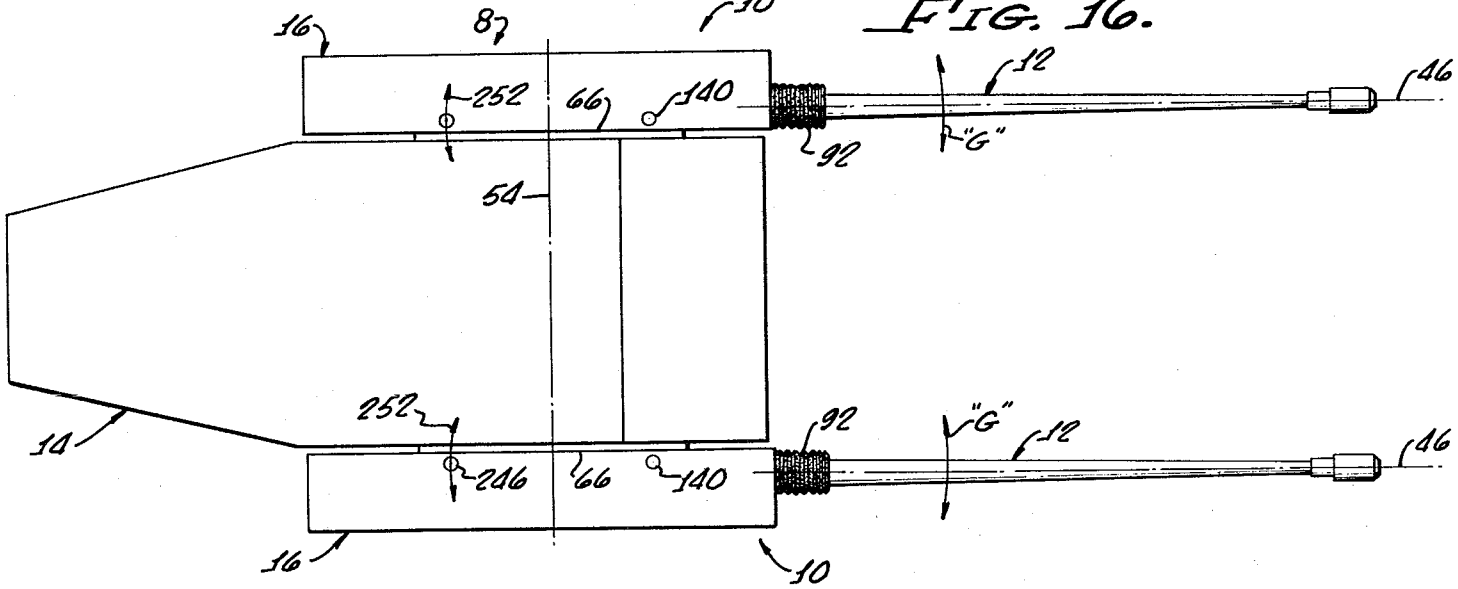
FIG. 16 is a top plan view, in pictorial form, of the weapon system cradle of FIG. 1, showing azimuthal bore sighting of the cradle mounted cannon.

Azimuthal bore sight adjustment is by positionally adjusting the third ball shaft 248 inwardly or outwardly along the corresponding axis 252. As such ball member shaft positional adjustment is made, the entire closed cradle 16, with and the cannon 12 mounted therein, pivots in the directions of Arrow "G", FIG. 16, about a pivotal axis through the the balls 142 and 218 of the first and second mounting means 18 and 20. In this regard, relative location of those balls 142 and 218 is such that an extension of the second ball shaft axis 160 passes through both the balls 142 and 218, and hence forms the bore sight azimuth adjustment axis which is generally orthogonal to the barrel bore axis 46.

It is emphasized that adjustably moving the closed cradle 16, relative to the member 64 in the above described manner, enables accurate bore sight adjustment of the cannon 12 while the cannon is in the actual firing position. Due to the described configuration of the cradle mounting means 18, 20 and 22, after cannon bore sighting adjustment have been made, the cradle 16 may be repeatedly opened and closed for cannon maintenance and so forth without affecting the bore sight adjustment.

In addition, because of the manner of bore sighting by adjustably moving the cradle 16 relative to the member 64, the cannon mounting means 24 is also in effect bore sighted so that subsequent bore sighting is usually not required when the entire cannon 12 is removed from, and reinstalled in, the cradle. In addition, replacement cannon installed in the mounting means 24 will ordinarily be sufficiently accurately bore sighted to enable effective use of such cannon, if necessary, in combat condition, during an interim period until a subsequent, completely accurate bore sighting, which takes into consideration individual cannon characteristics, can be performed.

Although there has been described above a specific arrangement of cannon mounting cradle apparatus in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

We claim:

1. In a weapons system including a gun turret having an exposed member pivotally mounted on an elevational axis and at least one automatic cannon, cradle apparatus for mounting the cannon to said member, which comprises:

(a) a rigid, cannon receiving cradle;

(b) first, second and third mounting means arranged in a triangular configuration for mounting the cradle to said member for pivotal cradle movement relative thereto between closed and open positions, said first mounting means including latching means for releasably latching the cradle to said member, said second and third mounting means including hinging means defining a cradle hinge line therethrough and enabling the cradle to pivot about said hinge line between the closed and open positions when the latching means is in an unlatched condition; and (c) means for mounting a cannon in the cradle for access thereto when the cradle is pivoted to the open position.

2. The gun cradle apparatus according to claim 1, wherein the first, second and third mounting means include adjusting means enabling the cradle to be adjustably positioned relative to said turret exposed member about cradle elevational and azimuthal rotational axes for enabling bore sighting of a cannon mounted in the cradle.

3. The gun cradle apparatus according to claim 2, wherein each of the first, second and third mounting means includes cradle portions fixed to the cradle and turret portions fixed to said exposed member and universal connecting means therebetween, the universal interconnecting means of the second and third mounting means comprising the hinging means thereof.

4. The gun cradle apparatus according to claim 3, wherein the universal connecting means of the first and second mounting means are positioned and oriented relative to the cradle and the exposed turret member to define a bore sight azimuth adjustment axis generally orthogonal to a barrel bore axis through a cannon mounted in the cradle and in a vertical plane when the member elevation axes is horizontal, and wherein the universal connecting means of the third mounting means is positioned and oriented relative to the cradle and the exposed turret member to define a bore sight elevation axis parallel to the member elevation axis.

5. The gun cradle apparatus according to claim 4, wherein the adjusting means of the first, second and third mounting means include the universal connecting means thereof and means enabling positional adjustment of the universal connecting means, the universal connecting means of the first and second mounting means being positionally adjustable generally along the bore sight azimuth axis therethrough to thereby cause pivotal bore sight elevational movement of the cradle relative to said member about the bore sight elevational axis and the universal connecting means of the third mounting means being positionally adjustable generally along the bore sight elevation axis therethrough to cause pivotal bore sight azimuthal movement of the cradle relative to said member about the bore sight azimuth axis.

6. The gun cradle apparatus according to claim 5, wherein each of the universal connecting means includes a ball mounted on a shaft threadably mounted to one of the associated mounting means cradle and turret portions and a ball receiving socket mounted to the other one of said associated cradle and turret portions.

7. The gun cradle apparatus according to claim 6, wherein a longitudinal axis of the threaded shaft associated with the third mounting means is along the bore sight elevation axis and wherein longitudinal axes of the threaded shafts associated with the first and second mounting means are generally along an arc centered at said longitudinal axis of the third mounting means shaft.

8. The gun cradle apparatus according to claim 6, wherein the latching means of the first mounting means includes the ball receiving socket associated therewith, said socket being pivotally mounted to the first mounting means cradle portion and including means defining a ball admitting side opening and having an outwardly extending handle fixed thereto for pivoting the socket between an unlatched position in which said side opening is oriented for admitting and releasing the associated ball and a latched position in which the side opening is oriented for preventing releasing of the received, associated ball.

9. The gun cradle apparatus according to claim 8, wherein the first mounting ball receiving socket and cradle portion include means for frictionally locking the ball in the socket when the socket is in the latched position.

10. The gun cradle apparatus according to claim 8, including means for releasably locking the handle when said socket is in the latched position.

11. The gun cradle apparatus according to claim 1, including means for assisting pivotal movement of the cradle between the closed and open positions.

12. The gun cradle apparatus according to claim 11, wherein the assisting means includes a crank operated winch mounted to the turret exposed member.

13. The gun cradle apparatus according to claim 1, including releasable locking means for preventing unintended unlatching of the latching means maintaining the cradle in the closed position relative to the exposed turret member.

14. The gun cradle apparatus according to claim 1, including electrical switch means adapted for preventing firing of a cannon mounted in the cradle unless the cradle is closed and latched.

15. The gun cradle apparatus according to claim 1, wherein the cradle includes means defining open side regions which abut the turret exposed member when the cradle is in the closed condition, and wherein the cradle pivots approximately 45° between the closed and open positions.

16. The gun cradle apparatus according to claim 15, wherein the cannon mounting means is configured for mounting a cannon in the cradle with a transverse plane through the cannon at an angle of approximately 45° relative to the turret explosed member when the cradle is in a closed condition, and at an angle of approximately zero degrees relative to said member when the cradle is in an open condition, whereby upper regions of the cannon are relatively exposed when the cradle is in an open condition.

17. The gun cradle apparatus according to claim 16, wherein the cannon includes shell feeding means and wherein the cradle includes means for mounting said feeding means in operative positional relationship to a cannon mounted in the cradle.

18. The gun cradle apparatus according to claim 17, wherein the means for mounting the feeding means is configured for enabling, when the cradle is in an open condition, the feeding means to pivot between closed and open shell feeding positions relative to a cannon mounted in the cradle.

19. The gun cradle apparatus according to claim 18, wherein the means for mounting the feeding means enables the feeding means to pivot through an angle of about 90° from the closed to the open shell feeding positions, portions of the cannon which are concealed when the feeding means are in the closed position being made accessible when the feeding means is in the open position.

20. The gun cradle apparatus according to claim 19, wherein both the cradle and the feeding means pivot in the same pivotal directions between open and closed positions thereof.

21. The gun cradle apparatus according to claim 1, wherein the cannon is formed having a plurality of longitudinally separated, laterally spaced apart pairs of mounting lugs in a generally common transverse plane, and wherein said means for mounting the cannon in the cradle includes a pair of laterally spaced apart, longitudinal tracks for slidably receiving said pairs of cannon mounting lugs.

22. The gun cradle apparatus according to claim 1, wherein the cradle includes means defining a substantially open forward end through which a barrel portion of the cannon forwardly projects, and means defining a substantially open side region which abuts the exposed turret member when the cradle is in a closed position and wherein other side regions and a rearward end of the cradle are substantially closed, to provide environmental protection to the cannon mounted in the cradle when the cradle is in a closed condition.

23. The gun cradle apparatus according to claim 22, wherein said other side regions which are substantially closed include at least first and second pivotally mounted access doors providing access to portions of the cannon when the cradle is in the closed position.

* * * * *

UNITED STATES PATENT AND TRADEMARK OFFICE

CERTIFICATE OF CORRECTION

PATENT NO. : 4,346,644

DATED : August 31, 1982

INVENTOR(S) : Vernet F. De Haven and Forrest Airhart

It is certified that error appears in the above—identified patent and that said Letters Patent is hereby corrected as shown below:

Column 1, line 29 change "attach" to --attack--

Column 4, line 57 change "or" to --of--

Column 6, line 57 after "torque" insert --tube--

Signed and Sealed this

Ninth Day of November 1982

[SEAL]

*Attest:*

GERALD J. MOSSINGHOFF

*Attesting Officer*

*Commissioner of Patents and Trademarks*